US005303012A

United States Patent [19]

Horlacher et al.

[11] Patent Number: 5,303,012

[45] Date of Patent: Apr. 12, 1994

[54] SINGLE MAGNET LATCH VALVE WITH POSITION INDICATOR

[75] Inventors: Wilhelm H. Horlacher, Newington; Harry S. Kuhlman, III, Berlin, both of Conn.

[73] Assignee: Honeywell Inc., Minneapolis, Minn.

[21] Appl. No.: 16,587

[22] Filed: Feb. 10, 1993

[51] Int. Cl.[5] ..... H01F 7/08; H01F 7/00

[52] U.S. Cl. ..... 335/253; 335/234; 335/255

[58] Field of Search ..... 335/253, 254, 229, 230, 335/234, 236, 174, 177, 179, 180, 17, 255

[56] References Cited

U.S. PATENT DOCUMENTS 5,032,812 7/1991 Banick et al. ..... 337/234

*Primary Examiner*—Harold Broome

*Attorney, Agent, or Firm*—William D. Lanyi

[57] ABSTRACT

An actuator is provided with a position sensing system which comprises a permanent magnet, a saddle plate, a sole plate and the magnetically sensitive component. The magnet and the magnetically sensitive component are disposed between the saddle plate and the sole plate which are spaced apart for these purposes. A moveable plunger is arranged to move along an axis relative to a stationary stop member. A first magnetic circuit is provide which comprises the permanent magnet, the saddle plate, the sole plate, the stop member and the moveable plunger. A second magnetic circuit is provided which comprises the magnet, the saddle plate, the sole plate and a magnetically sensitive component such as a Hall effect element. In addition, an adjustment means can be provided within the second magnetic circuit to change the reluctance of that circuit for adjustment purposes. When the plunger is moved away from the stop member, an air gap exists therebetween which provides sufficient reluctance to the first magnetic circuit to permit the permanent magnet to provide a sensible magnetic field at the magnetically sensitive component. When the plunger moves into contact with the stop member, the reluctance of the first magnetic circuit decreases sufficiently to decrease the magnetic field strength of the second magnetic circuit to a magnitude which is detectable by the Hall effect element.

20 Claims, 4 Drawing Sheets

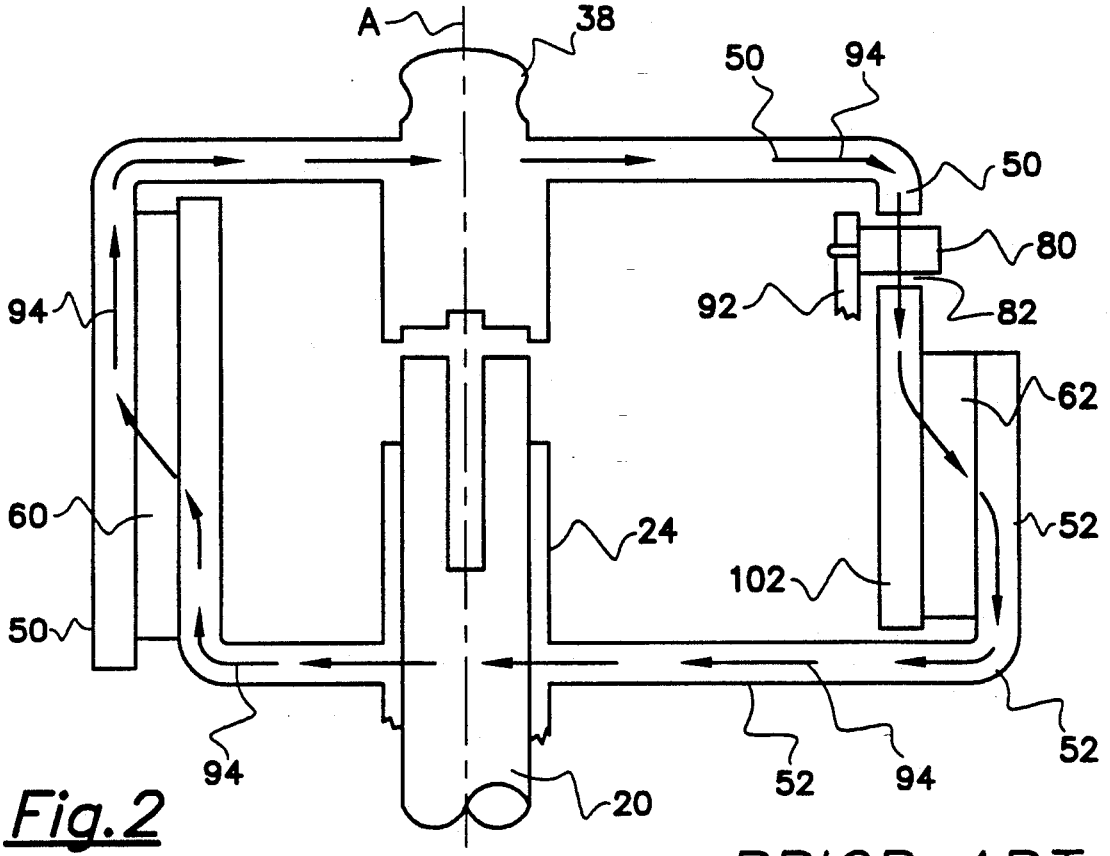
Fig. 2
PRIOR ART
Fig. 3
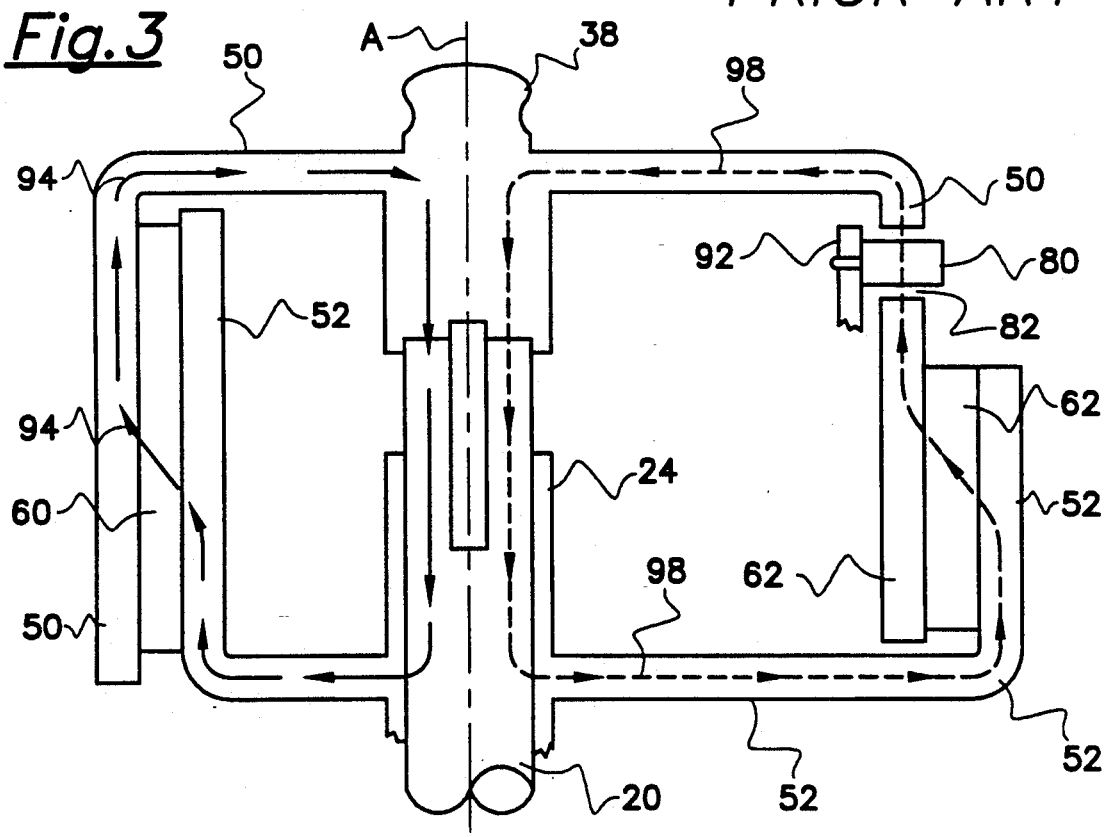

SINGLE MAGNET LATCH VALVE WITH POSITION INDICATOR

BACKGROUND OF THE INVENTION

1. Field of the Invention:

The present invention relates generally to a latch valve which is operated by a solenoid device and, more particularly, to an apparatus which incorporates a single permanent magnet and a magnetically sensitive device to indicate the position of a plunger that is actuated in response to a magnetic field provided by a solenoid.

2. Description of the Prior Art:

Many types of actuators are known to those skilled in the art. In certain types of actuators, solenoid apparatus is provided to cause a slidable plunger, or core, to move from a first position to a second position in response to a magnetic field induced by an electric current flowing through a coil of the solenoid. Many solenoid actuators of this type do not provide a means for determining the actual condition of the actuator. In other words, when an electric current is provided to the coil of the solenoid to move the plunger toward one position or the other, no means is readily available to determine if the plunger actually responded to the magnetic field. In solenoid actuators which are configured to provide a latching capability, wherein a momentary actuation of the solenoid causes the plunger to move into a first or a second position and other means are provided to hold the plunger in its position after the solenoid coil is deactivated, it is particularly important to be able to determine the actual position of the plunger. The means for determining the actual position of the plunger is important because several malfunctions can possibly cause the plunger to be in a position other than that which is intended. For example, the solenoid coil may not actually have been actuated by the anticipated flow of current through its conductor. This could be caused by a broken wire or a disconnection in the electrical circuit of the solenoid. Even if the solenoid operates properly and the plunger moves in the intended direction, a subsequent shock to the apparatus could possibly dislodge the plunger from its latched position.

In actuators which are provided with a latching capability, a solenoid coil is typically energized for a brief period of time to cause the core, or plunger, to move into contact with a stop member or plugnut. When the coil is de-energized, the plunger is maintained in the engaged position with the stop member by a permanent magnet which produces a continuous magnetic flux in the magnetic circuit in the same direction as that which was produced by the original energization of the coil. This causes the core to be latched in contact with the stop member by the permanent magnet flux. When the core, or plunger, is to be unlatched, the solenoid coil is energized with an electric current of opposite polarity to that current which was originally used to actuate the coil. Alternatively, a second coil can be wound in the solenoid in a direction which is opposite to the energizing coil. In both alternative applications, the coil produces a magnetic field which is opposite to the field produced by the permanent magnet and therefore allows a return spring to separate the plunger from the stop member and move the plunger to a position which is in noncontact association with the stop member. In these types of solenoid actuator apparatus, the solenoid coil is not continuously energized to maintain the core in either one of its two positions. Momentary electric pulses are applied to the coil, or coils, to cause the plunger to shift between its first and second positions.

As is known to those skilled in the art, certain devices have been developed to permit the detection of the position of the plunger relative to the stop member. One such device is described in U.S. Pat. No. 5,032,812, which issued to Banick et al on Jul. 16, 1991. The Banick et al patent discloses a solenoid actuator which has a magnetic flux sensor. The actuator comprises a coil or coils of electrical wire, a plugnut or stop member and a moveable core within the coils of the solenoid. A magnetic yoke surrounds the coil and the axis of the coil extends across the magnetic circuit defined by the yoke. Relatively large and small permanent magnets are associated with the yoke on opposite sides of the axis of the solenoid. The magnets produce flux in opposite directions to each other. A flux sensor, disposed closer to the small magnet than the large magnet, senses changes in direction of the flux. When the core and plugnut are separated, a large magnetic flux predominates throughout the yoke. When the core engages the plugnut, the small magnet flux predominates in its portion of the yoke. Changes in the direction of magnetic flux are detected by a sensor. Therefore, the sensor can be used to indicate the position of the core with respect to the plugnut.

SUMMARY OF THE INVENTION

In a preferred embodiment of the present invention, a solenoid actuator comprises a coil having a central axis. A core is made of a magnetically permeable material and is slidably disposed within the coil. The plunger, or core, is moveable along the axis of the coil in response to a magnetic field induced by an electrical current flowing through the solenoid coil. A stationary stop member is disposed in the path of the core, along the central axis, to limit the travel of the core in a first direction along the axis. A preferred embodiment of the present invention also comprises a single permanent magnet and a magnetically sensitive component. The present invention also comprises a first means for providing a first magnetic circuit comprising the magnet, the stationary stop member and the core. The reluctance of the first magnetic circuit is variable in response to movement of the core relative to the stationary stop member. In other words, when the core moves away from the stationary stop member, the gap between these two components increases the reluctance of the first magnetic circuit by creating the air gap which has a higher reluctance than the magnetic material of which the moveable core and stationary stop member are made. The present invention also comprises a second means for providing a second magnetic circuit comprising the magnet and the magnetically sensitive component. The magnetic field strength of the second magnetic circuit is variable in responses to changes in the reluctance of the first magnetic circuit. In other words, as the reluctance of the first magnetic circuit increases because of the introduction of an air gap between the noveable plunger and the stationary stop member, the strength of the magnetic field provided by the permanent magnet and passing through the second magnetic circuit increases. The magnetically sensitive component is provided with an output signal which is representative of the magnetic field strength of the second magnetic circuit. The magnetically sensitive component, in a preferred embodiment of the present invention, is a Hall effect device. When the magnetic field strength of the second magnetic circuit increases, this increase in magnetic flux is sensed by the Hall effect device and this increase in magnetic flux is represented by a change in the output signal from the magnetically sensitive component.

In a particularly preferred embodiment of the present invention, the first providing means comprises a saddle plate and a sole plate which are spaced apart from each other with the permanent magnet being disposed therebetween. The second providing means also comprises the same saddle plate and sole and the magnetically sensitive component is disposed therebetween. In a preferred embodiment of the present invention, a means is provided for adjusting the reluctance of the second magnetic circuit. In one particular embodiment, this adjusting means is a threaded member, such as a screw, which is disposed in the vicinity of the magnetically sensitive component and in series with the magnetically sensitive component within the second magnetic circuit. By changing the effective length of the screw relative to the position of the magnetically sensitive component, the air gap between the magnetically sensitive component and the screw can be increased or decreased to determine a preferred magnitude of reluctance within the second magnetic circuit.

One particular application of the present invention also comprises a valve body which is attached to the actuator. The valve body is provided with a fluid conduit formed therein which is able to be obstructed by a movement of the plunger toward an opening formed in the conduit.

The present invention represents a significant improvement in devices which sense the position of a moveable magnetically permeable object by eliminating the use of two permanent magnets and replacing them with a single permanent magnet disposed between the moveable magnetic object, or plunger, and a magnetically sensitive component. It provides a magnetic field which extends along two different magnetic circuits which can each vary in strength. One magnetic circuit, comprising the permanent magnet, the moveable magnetic object, a stop member and two plates, conducts the magnetic field which increases in strength when the stop member and the moveable magnetic member, or plunger, are in close proximity with each other. The other magnetic circuit, comprising the permanent magnet, the magnetically sensitive component and the two plates, conducts the magnetic field which increases in strength when the reluctance of the first magnetic circuit increases in response to movement of the plunger away from the stop member to create a gap therebetween. It should be understood that both magnetic circuits continually provide parallel paths for the magnetic field provided by the magnet, although in different and varying strengths. The proportion of the permanent magnet's field passing through each of the magnetic circuits is determined by the reluctance of the first magnetic circuit which is, in turn, determined by the size of the gap between the plunger and the stop member. As this gap increases, the stray magnetic field extending along the second magnetic circuit increases in magnitude and, as a result, the magnetic field passing through the magnetically sensitive component increases and causes a signal from the magnetically sensitive component to represent that increase in the gap. Therefore, movement of the plunger changes the portion of the magnetic field in the two magnetic circuits and causes the magnetically sensitive component, such as a Hall sensor, to provide a signal which represents this plunger movement.

BRIEF DESCRIPTION OF THE DRAWINGS

The present invention will be more clearly understood from a reading of the Description of the Preferred Embodiment in conjunction with the drawings, in which:

FIGS. 2 and 3 show schematic illustrations of the actuator of FIG. 1 with the plunger at its two possible positions;

DESCRIPTION OF THE PREFERRED EMBODIMENT

Figure 1:
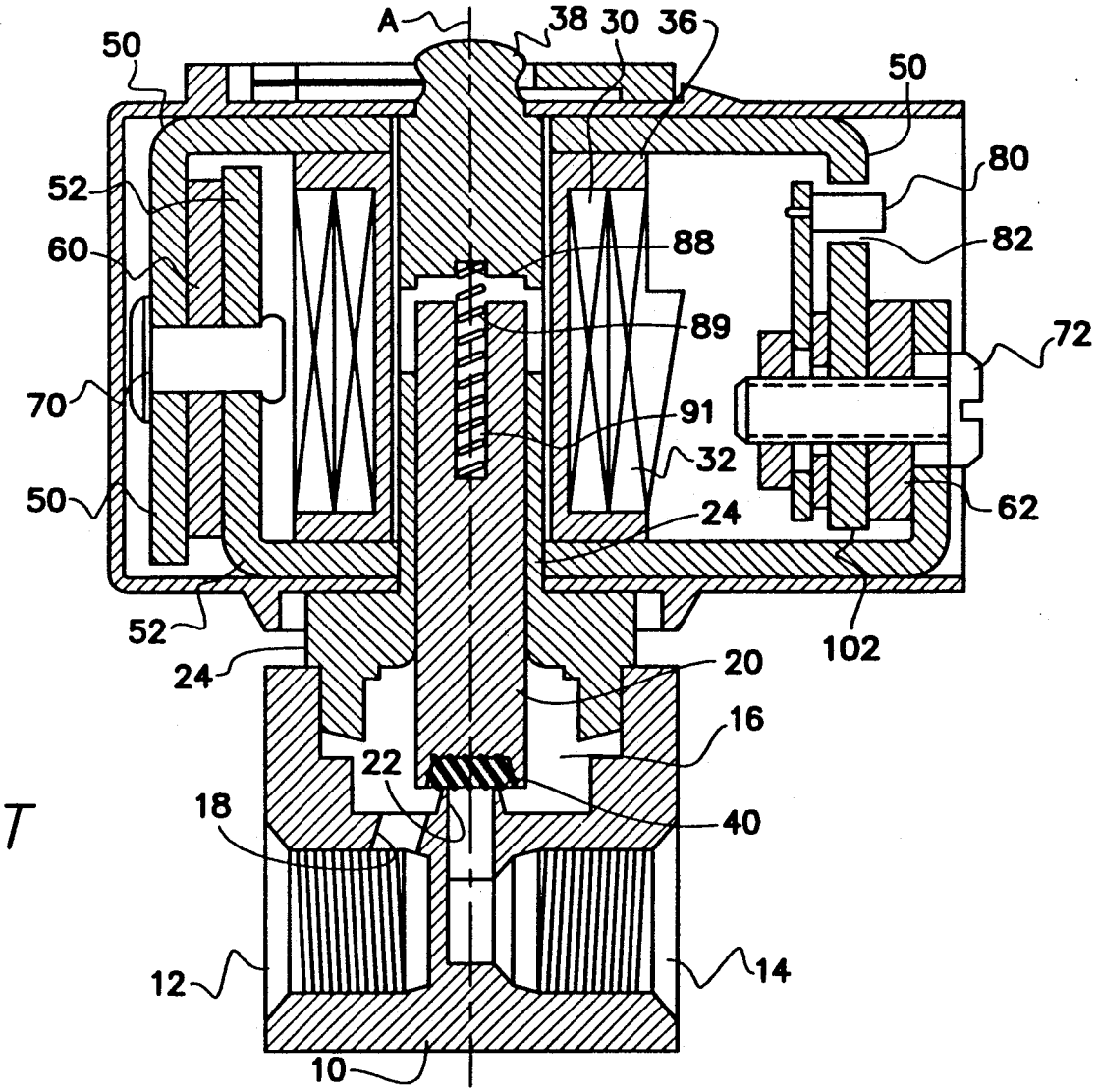
Fig.1 PRIOR ART
FIG. 1 shows a sectional view of a solenoid actuated valve which is known to those skilled in the art.

Throughout the Description of the Preferred Embodiment of the present invention, like component will be identified by like reference numerals.

FIG. 1 shows a sectional view of a solenoid actuator such as that which is described in U.S. Pat. No. 5,032,812. The actuator shown in FIG. 1 comprises a magnetic latch solenoid which is used to actuate a valve. The valve body 10 is provided with a fluid conduit formed therein which comprises an inlet 12 and an outlet 14. The construction of the valve body 10 includes a chamber 16 into which a fluid flows after entering the inlet port 12. Internal passageway 18 connects the inlet port 12 with chamber 16. If the plunger 20 is in its upward position, orifice 22 is opened and the fluid can flow from chamber 16 toward the outlet port 14. As can be seen in FIG. 1, the movement of the plunger 20 into its downward position blocks the orifice 18 and prevents the flow of fluid from chamber 16 toward the outlet port 14.

With continued reference to FIG. 1, it can be seen that the plunger 20 is disposed for movement along axis A within bonnet 24. Two concentric coils, 30 and 32, are disposed in coaxial relation with plunger 20 and axis A. The coils comprise an electrical wire wound around a spool 36. The apparatus shown in FIG. 1 also comprises a plugnut 38 which is fixed at a position relative to the two concentric coils, 30 and 32. The plugnut 38 operates to stop movement of the plunger 20 in an upward direction when a magnetic flux provided by one or more of the coils urges it upward along axis A. Downward movement of the plunger 20 is stopped at a second position when a resilient seal 40 moves into contact with the upper end of the valve body 10 where the orifice 22 intersects with chamber 16.

Two magnetically permeable members are used to provide magnetic circuits within the apparatus shown in FIG. 1. A first magnetic structure 50 and a second magnetic structure 52 are shaped to hold two permanent magnets. The first permanent magnet 60 is much stronger than a second permanent magnet 62. A fastening device, such as rivet 70, is used to hold the first magnet 60 in its position between the first and second magnetic members, 50 and 52, and a second fastening device 72 is used to hold the second permanent magnet 62 in the position shown in FIG. 1. A magnetically sensitive device, such as Hall device 80 is disposed where shown with a gap 82 separating the Hall device from the other components in the magnetic circuit. The coils can be energized by providing an electric current through them. the plunger is slidable within a tube extending through the coils and is moveable between a lower position at which it engages the valve sent to close the valve by obstructing orifice 22 and an upper position in which the plunger moves into contact with the plugnut 38. A spring 89 is disposed in an opening 91 formed in both the plugnut 38 and the plunger 20 to urge the plunger downward. The relatively large and strong permanent magnet 60 is arranged between the first and second magnetic members, 50 and 52, and is joined together by rivet 70. The two permanent magnets are located on opposite sides of axis A.

FIG. 2 shows the device of FIG. 1 in a schematic representation to illustrate the magnetic circuits provided by the first and second permanent magnets. When the plunger 20 is separated from plugnut 38 as shown in FIG. 2, the first permanent magnet 60 provides a magnetic field represented by arrows 94. They are shown passing in a clockwise direction in FIG. 2 from the first magnet 60, through the first magnetic member 50 and the plugnut 38. As indicated by arrows 94, the magnetic flux provided by the first permanent magnet 60 continues in a clockwise direction from plugnut 38 through a portion of the first magnetic member 50 and the Hall effect device 80 toward the second permanent magnet 62. Since the first permanent magnet is significantly stronger than the second permanent magnet, the magnetic field provided by the first permanent magnet 60 overpowers the magnetic field provided by the second permanent magnet 62 and continues in its magnetic circuit through magnetic member 52, core tube 24 and plunger 20 to return to the first permanent magnet 60 in completion of the magnetic circuit. This provides a magnetic field perpendicular to the Hall effect device 80 which causes the Hall effect device to provide a predetermined signal representing the downward position of plunger 20.

FIG. 3 is a schematic representation of the device in FIG. 1 with the plunger 20 in its upward position in contact with plugnut 38. When the plunger 20 is in contact with plugnut 38, the air gap between these two components is eliminated and the overall reluctance of the magnetic circuit represented by arrows 94 is significantly reduced. Because this reduced reluctance, the magnetic field provided by the first permanent magnet 60 finds its path of least reluctance through the first magnetic member 50, the plugnut 38, the plunger 20 and a portion of the second magnetic member 52 to return to the first permanent magnet 60. Because of this is the path of least reluctance, the magnetic field does not stray, to any significant degree, into the first and second magnetic members, 50 and 52, to the right of axis A. Therefore, there is very little effect on the Hall effect device 80 as a result of the magnetic field of the first permanent magnet 60. The second permanent magnet 62, although weaker than the first permanent magnet 60, can therefore provide a magnetic field which is represented by dashed arrows 98 in FIG. 3. That magnetic circuit provided by the second permanent magnet 62 passes from the magnet 62 in a counterclockwise direction through a magnetically permeable member 102, the magnetically sensitive device 80, a portion of the first magnetic member 50, the plugnut 38, the plunger 20 and a portion of the second magnetic member 52 before returning to the second permanent magnet 62. The upwardly directed magnetic field passing through the Hall effect device 80 provides an output signal that is opposite in polarity to that provided by the downward flow of the magnetic field 94 illustrated in FIG. 2.

As illustrated in FIGS. 1, 2 and 3, this apparatus which is known to those skilled in the art uses two permanent magnets to provide two separate magnetic circuits in opposite directions through magnetically permeable members connected to the plugnut, the plunger, the magnets and the magnetically sensitive device. One of the permanent magnets is significantly stronger than the other and is sufficiently strong to overpower the second permanent magnet when the plunger is moved away from the plugnut. As is evident in the description and in FIGS. 1, 2 and 3, the use of two permanent magnets to provide a signal representing the position of the plunger requires a relatively complex structure and a precise selection of permanent magnets having particular magnetic strengths which, in combination with the relatively complex magnetic circuit components described above, result in the variability of signal through the Hall effect device which can represent the position of the plunger.

Figure 4:
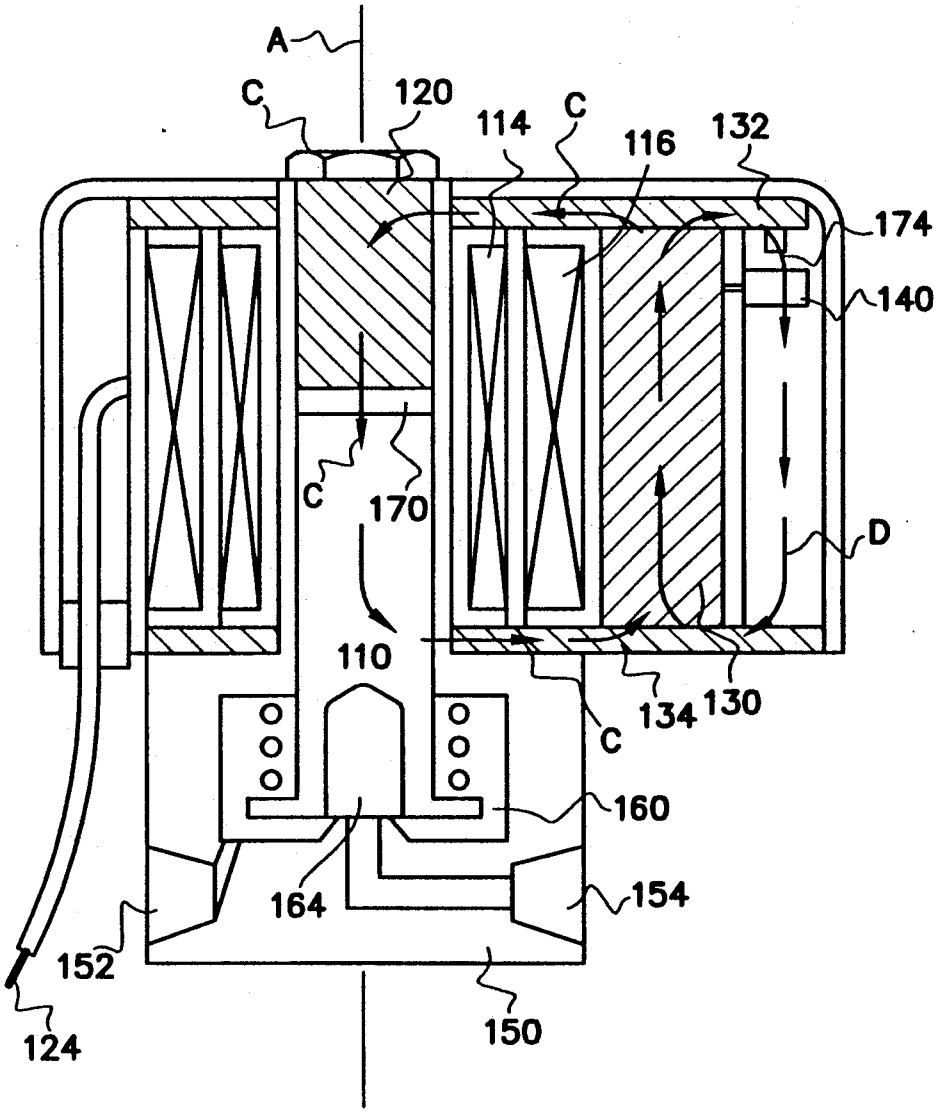
FIG. 4 shows a sectional view of the present invention with the plunger moved away from the stop member to block flow through a conduit within a valve body.
Figure 5:
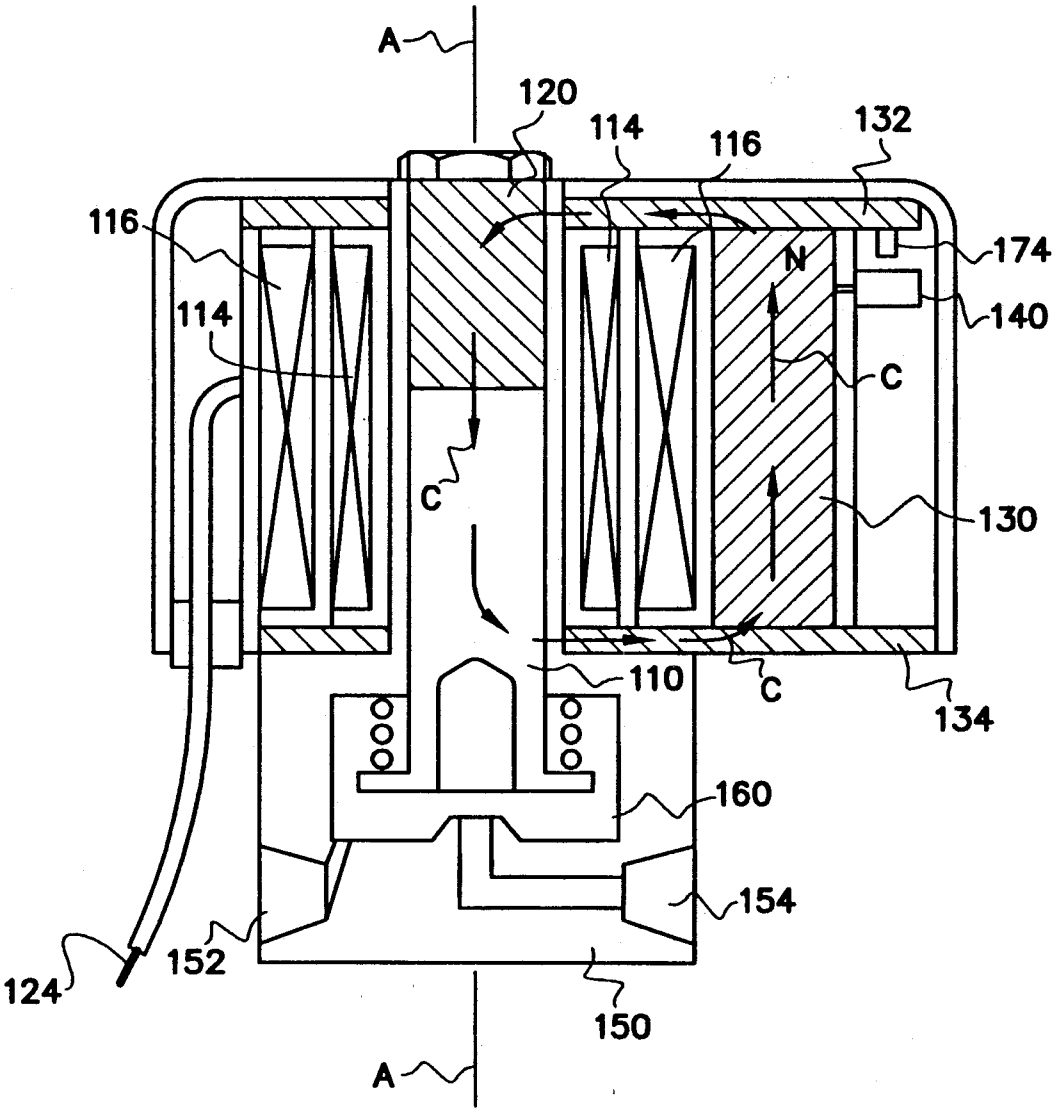
FIG. 5 shows a sectional view of the present invention with the plunger in contact with the stop member to permit flow through the conduit of a valve body.

FIGS. 4 and 5 illustrate sectional views of the present invention with the plunger in its downward position and upward position, respectively. With reference to FIG. 4, a plunger 110 is disposed within a solenoid arrangement such as that represented by coils 114 and 116. A stop member 120 is disposed along axis A to prevent upward movement of plunger 110 beyond a first position defined by the lower surface of the stop member. Means, such as wires 124, are provided to permit an electric current to flow through the conductors of the coils. A single permanent magnet 130 is disposed between a saddle plate 132 and a sole plate 134 as shown in FIG. 4. The saddle plate 132 and the sole plate 134 are spaced apart and the permanent magnet 130 and a magnetically sensitive component 140 are disposed therebetween and the magnet 130 is disposed between the plunger 110 and the magnetically sensitive object 140. The magnetically sensitive component 140 is a Hall effect device in a preferred embodiment of the present invention. A valve body 150 is attached to the actuator and a conduit is provided therein. For example, an inlet port 152 and an outlet port 154 are provided in the valve body 150 with a chamber 160 formed therebetween. The construction of the valve body 140 is similar to that described above in relation to FIG. 1 and will not be described in detail herein. A lower portion of the plunger 110 is provided with a resilient member 164 which moves into obstructing relation with the conduit formed in the valve body 150.

With continued reference to FIG. 4, when the plunger 110 is in obstructing relation with the conduit in the valve body 150 in response to a previous momentary magnetic field induced in the coils by an electric current flowing through them, a gap 170 exists between the stop member 120 and the plunger 110. This gap 170 significantly increases the reluctance of a magnetic circuit which comprises the permanent magnet 130, the saddle plate 132, the stop member 120, the plunger 110 and the sole plate 134 as represented by arrows C which illustrate a counterclockwise magnetic circuit in FIG. 4. This increased reluctance in this first magnetic circuit increases the magnetic field strength in a second magnetic circuit which comprises the permanent magnet 130, the saddle plate 132, the magnetically sensitive component 140 and the sole plate 134. This second magnetic circuit is represented by arrows D which show a clockwise path in FIG. 4. A magnetic field extends downward through the magnetically sensitive device 140 and provides a signal at an output of that device, which is a Hall effect element in a preferred embodiment of the present invention. Also shown in FIG. 4 is a means 174 for adjusting the reluctance of the second magnetic circuit. By changing the depth to which a screw is inserted into the saddle plate 132, the gap between the screw and the Hall effect element of the magnetically sensitive component 140 changes and therefore the reluctance of the second magnetic circuit, represented by arrows D, also changes. This permits the device to be adjusted to provide a predefined signal magnitude of the output from the magnetically sensitive device 140.

FIG. 5 is very similar to FIG. 4 except that the plunger 110 is in its upward position against the stop member 120. When the plunger 110 is in this first position, the gap between the stop member 120 and the plunger 110 is removed and the reluctance of the first magnetic circuit is significantly decreased. Because of this reduced reluctance, increased magnitude of the magnetic flux provided by the permanent magnet 130 passes upward from the permanent magnet toward the saddle plate 132 and, in a counterclockwise direction, toward the stop member 120. The magnetic circuit continues from the stop member 120 through the plunger 110 and into the sole plate 134 before returning to the permanent magnet 130. The second magnetic circuit, described above in relation to FIG. 4, has a much higher reluctance than the first magnetic circuit illustrated by arrows C in FIG. 5 because of the significant air gap below the magnetically sensitive component 140 and the smaller air gap between the magnetically sensitive component 140 and the adjusting means 174 which is a screw in a preferred embodiment of the present invention. Because of this much higher reluctance in the second magnetic circuit, a predominant portion of the magnetic field of the permanent magnet 130 passes through the first magnetic circuit and avoids the second magnetic circuit. The result of this predominance of the first magnetic circuit in FIG. 5 is that the stray magnetic field passing through the magnetically sensitive component 140 is significantly decreased. This decreased magnetic field strength through the magnetically sensitive component provides a significantly lower signal which is recognized as being indicative of the upward position of plunger 110 against the stop member 120.

The magnetically sensitive component in a preferred embodiment of the present invention is a Hall sensor that is available in commercial quantities from the MICRO SWITCH division of Honeywell and which is identified as Catalog Listing SS443A. It should be apparent that the signal provided by the magnetically sensitive component 140 can alternatively be selected to be an analog output signal or a digital output signal. This result depends on the selection of the magnetically sensitive component. Both of these alternative choices are available within the scope of the present invention.

As described above, latching solenoids can be operated in several alternative ways. The particular selection of operation of the solenoid, whether it utilizes a single coil or two coils, is not limiting to the present invention. The present invention is applicable with any type of solenoid actuator in which a moveable plunger is disposed within the cavity of the solenoid valve body and positioned by momentarily energizing a latch coil. The latch coil can be wound and electrically energized such that the resulting magnetic field aids the field produced by a permanent magnet which is also disposed within the valve actuator. When the plunger moves to its first position, the electrical connection to the latch coil can then be disconnected. The plunger is maintained in the latched position solely by the magnetic field provided by the permanent magnet. To cause movement of the plunger from the first position to a second position, a release coil can be energized. The release coil is also wound and electrically energized so that the resulting magnetic field opposes the field of the permanent magnet. This reduces the net magnetic field to a level that is insufficient to overcome the force exerted on the plunger by an associated spring. The spring force then causes the plunger to be returned to its second, or released, position. Therefore, a momentary electrical pulse applied to the latch coil opens the valve and the permanent magnet holds the plunger in the latched position. A momentary electrical pulse applied to the release coil closes the valve. Adjacent to the permanent magnet, a magnetically sensitive component is mounted. This component can be a Hall effect sensor. The location is carefully chosen to provide the correct magnetic field levels for proper sensor operation. When the valve plunger is in the closed position, a relatively large air gap is present between the top of the plunger and the bottom of the stop member. This air gap causes a relatively large amount of stray, or leakage, magnetic flux to be present in a direction perpendicular to the sensitive surface of the Hall effect element. This relatively large magnitude of flux is detected by the Hall effect element and it produces an output signal which can be used by externally connected circuitry to detect the position of the plunger. When the valve plunger is in the open position, the air gap between the plunger and the stop member is reduced to a very small magnitude. In fact, the air gap between the stop member and the plunger essentially disappears. This reduces the amount of stray, or leakage, flux at the Hall effect element to a very small value because the decrease in the reluctance of the first magnetic circuit results in a decrease in the magnetic field strength of the second magnetic circuit. This reduction in magnetic flux causes the output of the Hall effect element to be reduced from the output produced when the plunger was in the second position. The adjustment screw is located in the saddle plate above the Hall effect element to permit the amount of stray flux at the sensor surface to be adjusted.

Although the present invention has been described with significant detail and illustrated with great specificity to show its most preferred embodiment, it should be understood that alternative embodiments are also within its scope. For example, the magnetically sensitive device need not be a Hall effect element, but can also be a permalloy component. In addition, the actuator need not be associated with the solenoid coil, but can be arranged in association with any other type of actuator that can cause a device, such as the plunger, to move between first and second positions. Also, although a preferred embodiment of the present invention is used as an actuator in association with a valve body, the presence of the valve body and its conduit are not necessary with all embodiments of the present invention.

The embodiments of the invention in which an exclusive property or right is claimed are defined as follows:

1. A solenoid actuator, comprising:
a coil having a central axis;
a plunger disposed within said coil, said plunger being magnetic and slidable within said coil in response to a magnetic field induced by an electrical current flowing through said coil;
a stationary stop member disposed in the path of said plunger to limit the travel of said plunger in a first direction along said central axis;
a magnet;
a magnetically sensitive component;
first means for providing a first magnetic circuit comprising said magnet, said stationary stop member and said plunger, the reluctance of said first magnetic circuit being variable in response to movement of said plunger relative to said stationary stop member; and
second means for providing a second magnetic circuit comprising said magnet and said magnetically sensitive component, a magnetic field strength of said second magnetic circuit being variable in response to changes in said reluctance of said first magnetic circuit, said magnetically sensitive component having an output signal, said output signal being representative of said magnetic field strength of said second magnetic circuit, said magnet being disposed between said magnetically sensitive component and said plunger.

2. The actuator of claim 1, wherein:
said first providing means comprises a saddle plate and a sole plate, said saddle plate and said sole plate being spaced apart from each other with said magnet being disposed therebetween.

3. The actuator of claim 2, wherein:
said second providing means comprises said saddle plate and said sole plate with said magnetically sensitive component disposed therebetween.

4. The actuator of claim 3, further comprising:
means for adjusting the reluctance of said second magnetic circuit.

5. The actuator of claim 1, wherein:
said magnetically sensitive component is a Hall effect element.

6. The actuator of claim 1, further comprising:
a valve body attached to said actuator.

7. The actuator of claim 6, wherein:
said plunger is moveable into obstructing relation with a fluid conduit within said valve body.

8. An actuator, comprising:
a magnetic object moveable in response to a stimulus along an axis between a first position and a second position;
a magnetic stop member disposed along said axis at said first position;
a magnet;
first means for providing a first magnetic circuit comprising said magnet, said magnetic object and said magnetic stop member;
a magnetically sensitive component; and
second means for providing a second magnetic circuit comprising said magnet and said magnetically sensitive component, the reluctance of said first magnetic circuit being variable in response to movement of said magnetic object relative to said magnetic stop member, a magnetic field strength of said second magnetic circuit being variable in response to changes of said reluctance of said first magnetic circuit, said magnetically sensitive component having an output signal, said output signal being representative of said magnetic field strength of said second magnetic circuit, said magnet being disposed between said magnetic object and said magnetically sensitive component.

9. The actuator of claim 8, wherein:
said first providing means comprises a saddle plate and a sole plate displaced apart from each other, said magnet being disposed between said saddle plate and said sole plate.

10. The actuator of claim 9, wherein:
said second providing means comprises said saddle plate and said sole plate, said magnetically sensitive component being disposed between said saddle plate and said sole plate.

11. The actuator of claim 8, wherein:
said magnetically sensitive component is a Hall device.

12. The actuator of claim 8, wherein:
said magnet is a permanent magnet.

13. The actuator of claim 8, further comprising:
a coil, said magnetic object being disposed within said coil and moveable in response to a magnetic field induced by an electric current flowing through said coil.

14. The actuator of claim 8, further comprising:
means for adjusting the reluctance of said second magnetic circuit.

15. The actuator of claim 8, further comprising:
a valve body having a fluid conduit formed therein.

16. The actuator of claim 15, wherein;
said magnetic object being moveable into obstructing relation with said fluid conduit when said magnetic object is disposed at said second position.

17. A solenoid actuator, comprising:
a coil having a central axis;
a magnetic object disposed within said coil, said magnetic object being moveable along said central axis in response to a magnetic field induced by an electric current flowing through said coil;
a magnetic stop member disposed at a first position along said central axis;
a permanent magnet;
a magnetically sensitive component; first means for providing a first magnetic circuit comprising said permanent magnet, said magnetic object and said magnetic stop member, a reluctance of said first magnetic circuit being variable in response to movement of said magnetic object relative to said magnetic stop member; and
second means for providing a second magnetic circuit comprising; said permanent magnet and said magnetically sensitive component, a magnetic field strength of said second magnetic circuit being variable in response to changes in said reluctance of said first magnetic circuit, said permanent magnet being disposed between said magnetically sensitive component and said central axis.

18. The actuator of claim 17, wherein:
said first providing means comprises a saddle plate and a sole plate displaced apart from each other with said magnet disposed therebetween.

19. The actuator of claim 18, wherein:

said second providing means comprises said saddle plate and said sole plate, said magnetically sensitive component being disposed between said saddle plate and said sole plate.

20. The actuator of claim 17, further comprising:

a valve body having a fluid conduit disposed therein, said magnetic object being moveable into obstructing relation with said fluid conduct, said magnetically sensitive component being a Hall effect device; and means for adjusting the reluctance of said second magnetic circuit.

* * * * *